US008107849B2

(12) United States Patent
Tomura et al.

(10) Patent No.: US 8,107,849 B2
(45) Date of Patent: Jan. 31, 2012

(54) IMAGE FORMING APPARATUS

(75) Inventors: Hisayuki Tomura, Izunokuni (JP); Kiyoharu Yoshioka, Mishima (JP); Michio Uchida, Susono (JP); Tomonori Shida, Boise, ID (US); Keisuke Mitsuhashi, Suntou-gun (JP); Takao Nada, Numazu (JP); Takuma Abe, Mishima (JP); Hidetoshi Yamashita, Machida (JP); Youhei Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 311 days.

(21) Appl. No.: 12/477,776

(22) Filed: Jun. 3, 2009

(65) Prior Publication Data

US 2009/0324278 A1 Dec. 31, 2009

(30) Foreign Application Priority Data

Jun. 5, 2008 (JP) ..... 2008-148202
May 12, 2009 (JP) ..... 2009-115541

(51) Int. Cl.

| | |
|---|---|
| ***G03G 15/00*** | (2006.01) |
| ***G03G 15/08*** | (2006.01) |
| ***G03G 15/20*** | (2006.01) |
| ***G03G 15/01*** | (2006.01) |

(52) U.S. Cl. ..... 399/101; 399/71; 399/121; 399/123; 399/303

(58) Field of Classification Search ..... 399/71, 399/101, 121, 123, 303
See application file for complete search history.

(56) References Cited

U.S. PATENT DOCUMENTS

| | | | | |
|---|---|---|---|---|
| 6,311,031 | B1 | 10/2001 | Hirano | |
| 2007/0048001 | A1 * | 3/2007 | Yamada | 399/99 |
| 2007/0230993 | A1 * | 10/2007 | Takeuchi | 399/101 |

FOREIGN PATENT DOCUMENTS

| | | | |
|---|---|---|---|
| JP | 2000-275983 | | 10/2000 |
| JP | 2001-356619 | | 12/2001 |
| JP | 2004-21142 | | 1/2004 |
| JP | 2005-91916 | | 4/2005 |
| JP | 2005134507 | A * | 5/2005 |
| JP | 2007-72373 | | 3/2007 |

* cited by examiner

*Primary Examiner* — David Gray
*Assistant Examiner* — Joseph Wong
(74) *Attorney, Agent, or Firm* — Canon USA Inc IP Division

(57) ABSTRACT

A compact image forming apparatus is provided in which stains on the back of a transfer material can be prevented. In particular, in a marginless print mode in which a toner image can be formed to the edge of a transfer material, a large amount of toner adheres to a transfer-material bearing member. The image forming apparatus includes a collecting member that can temporarily collect the toner adhering to the transfer-material bearing member. The toner that is temporarily collected by the collecting member is transferred to an intermediate transfer member and is cleaned by a cleaning unit.

7 Claims, 9 Drawing Sheets

IMAGE FORMING APPARATUS

BACKGROUND OF THE INVENTION

1. Field of the Invention

The present invention relates to an image forming apparatus for copying machines, printers, facsimiles, etc. which forms images by an electrophotographic system, an electrostatic recording system, etc.

2. Description of the Related Art

Electrophotographic full-color image forming apparatus transfers a developed image (toner image) from a photosensitive member, which is a first image bearing member that carries it, to an intermediate transfer member, which is a second image bearing member, at a primary transfer section. Furthermore, there are many commercialized products that employ an intermediate transfer belt system that transfers toner images in a plurality of colors superposed on the intermediate transfer member onto a transfer material, such as paper, at a secondary transfer section.

FIG. 9 is a schematic configuration diagram showing an example of an image forming apparatus using a conventional intermediate transfer belt system.

This image forming apparatus is configured to form toner images at a plurality of image forming sections provided along an intermediate transfer belt 8 on the basis of image input data. The image forming apparatus is configured to form electrostatic latent images on individual photosensitive drums 2, develop single-color toner images of the electrostatic latent images to form single-color toner images, superpose the single-color toner images formed at the individual image forming sections on the intermediate transfer belt 8 to form a multiple (multicolor) toner image, transfer the multiple toner image onto a transfer material, and fix the multiple toner image on the transfer material with a fixing device 21.

Here, drum-shaped photosensitive members (photosensitive drums) 2 (2*a*, 2*b*, 2*c*, and 2*d*) are arranged in a line at the color-image forming sections.

There are charging rollers 7 (7*a*, 7*b*, 7*c*, and 7*d*), exposure devices 1 (1*a*, 1*b*, 1*c*, and 1*d*), developing units 3 (3*a*, 3*b*, 3*c*, and 3*d*), photosensitive-drum cleaning units 5 (5*a*, 5*b*, 5*c*, and 5*d*) around the photosensitive drums 2, respectively. The photosensitive drums 2 corresponding to the individual colors are rotationally driven by driving units (not shown) at a predetermined processing speed.

The lower parts of the color photosensitive drums 2 are in contact with primary transfer rollers 4 (4*a*, 4*b*, 4*c*, and 4*d*), which are transfer members, with the endless intermediate transfer belt 8 serving as the second image bearing member therebetween, at individual primary-transfer nip portions.

The intermediate transfer belt 8 is stretched over a secondary-transfer counter roller 15 serving also as a driving roller, a tension roller 9, and a stretching roller 11 and is rotated in the direction of the arrow.

A transfer material P (not shown) that is a sheet conveyed from a paper cassette 20 is introduced from a registration roller pair 13 by a guide before secondary transfer 16 to a secondary-transfer nip portion formed by a secondary transfer roller 10 and the intermediate transfer belt 8. The toner image formed on the intermediate transfer belt 8 is transferred onto the transfer material P and is fixed by application of pressure and heat by the fixing device 21. Thus, the toner image can be formed on the transfer material P.

On the other hand, a toner image (waste toner) on the intermediate transfer belt 8 which cannot be transferred to the transfer material P at the secondary-transfer nip portion is cleaned by an intermediate-transfer-member cleaner 12.

With such a configuration, the secondary transfer roller 10 is always in contact with the intermediate transfer belt 8, and therefore, it is sometimes stained with the toner on the intermediate transfer belt 8. If the secondary transfer roller 10 is stained, the stain on the secondary transfer roller 10 stains the back of the transfer material P (a surface opposite to the transfer surface), that is, the back of the transfer material P is prone to be stained.

As a solution to those problems, for example, Japanese Patent Laid-Open No. 2001-356619 discloses an apparatus in which a waste-toner box for collecting removed toner is installed below the secondary transfer roller 10. This allows the secondary transfer roller 10 to be reliably cleansed without an influence of the intermediate transfer belt 8, thereby permitting high-quality printing with less back stain of the transfer material.

However, it is difficult for the system disclosed in Japanese Patent Laid-Open No. 2001-356619 to make the apparatus compact by a volume corresponding to the waste-toner box for the secondary transfer roller. In particular, with an image forming apparatus having a marginless print mode in which a toner image is formed to the edge of a transfer material, a large amount of toner adheres to the secondary transfer roller, which significantly increases the amount of toner to be collected. Therefore, in the system disclosed in Japanese Patent Laid-Open No. 2001-356619, the waste-toner box for the secondary transfer roller is increased, thus making it more difficult to minimize the apparatus. Even if a changeable waste-toner box for the secondary transfer roller is used to achieve minimization of the apparatus, a problem of increasing the frequency of replacement of the waste-toner box occurs.

SUMMARY OF THE INVENTION

The present invention provides a compact image forming apparatus in which stains on the back of a transfer material can be prevented. The invention provides a compact image forming apparatus having a marginless print mode in which a toner image is formed to the edge of a transfer material and in which stains on the back of a transfer material can be prevented. The image forming apparatus includes a rotatable image bearing member configured to bear a toner image; a rotatable intermediate transfer member to which the toner image is transferred from the image bearing member; a rotatable transfer-material bearing member configured to bear a transfer material; a transfer member that forms a transfer nip portion with the intermediate transfer member, with the transfer-material bearing member therebetween, and is configured to be able to transfer the toner image on the intermediate transfer member to the transfer material carried by the transfer-material bearing member; a collecting member configured to collect toner adhering to the transfer-material bearing member after the toner passes through the transfer nip portion; a cleaning unit configured to clean the toner remaining on the intermediate transfer member after the toner passes through the transfer nip portion; wherein the collecting member temporarily collects the toner adhering onto the transfer-material bearing member, and thereafter, again transfers the toner to the transfer-material bearing member; and the toner that is transferred from the collecting member to the transfer-material bearing member is transferred from the transfer-material bearing member to the intermediate transfer member by the transfer member and is then cleansed by the cleaning unit.

Further features of the present invention will become apparent from the following description of exemplary embodiments (with reference to the attached drawings).

DESCRIPTION OF THE EMBODIMENTS

Exemplary embodiments of the present invention will now be illustrated. The individual embodiments described below will be helpful in understanding a variety of concepts of the present invention from the generic to the more specific. Further, the technical scope of the present invention is defined by the Claims, and is not limited by the following individual embodiments.

First Embodiment

A first embodiment of the invention will be described hereinbelow with reference to the drawings.

Figure 1:
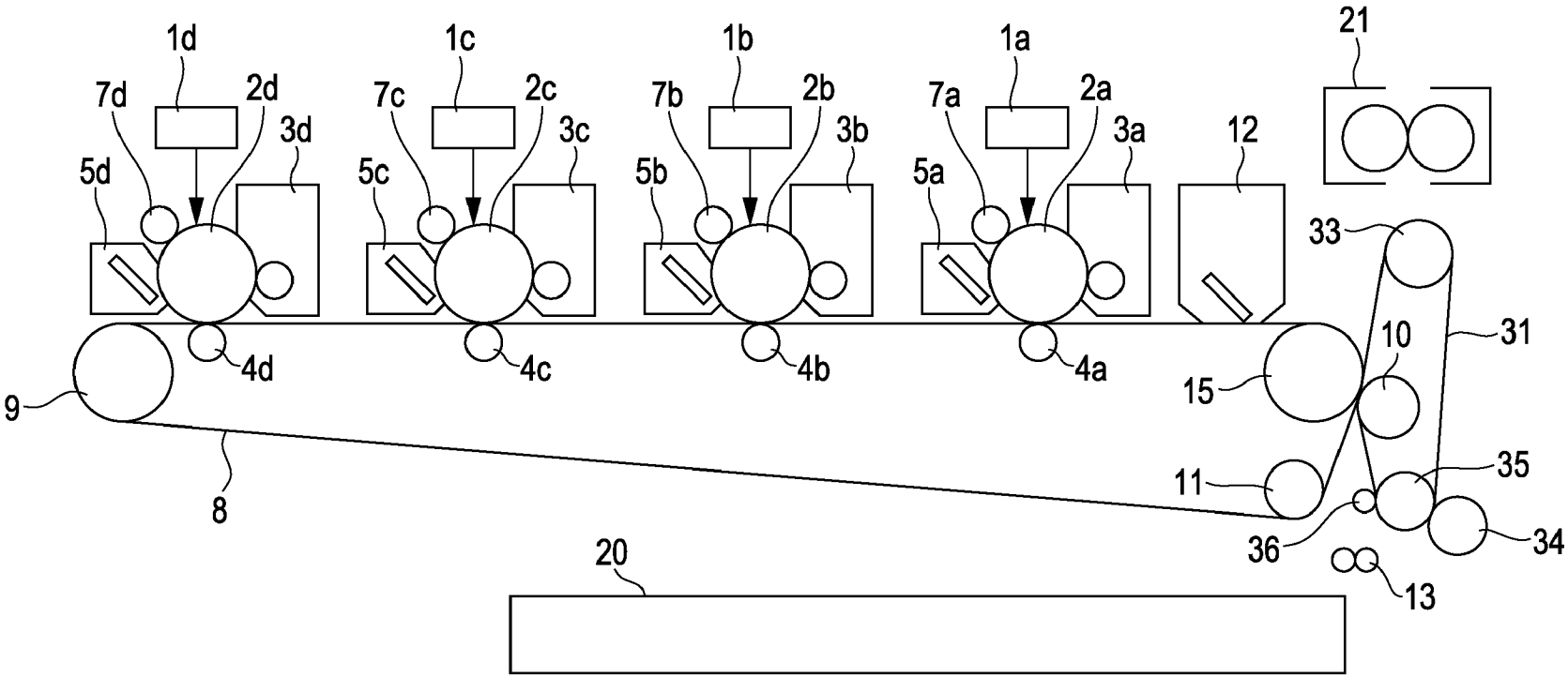
FIG. 1 is a sectional view showing the overall configuration of an image forming apparatus according to a first embodiment.

FIG. 1 is a schematic diagram showing the configuration of a color-image forming apparatus using an intermediate transfer system as an image forming apparatus of the embodiment. In this embodiment, a color-image forming apparatus using a tandem intermediate transfer system is used which forms individual color images by a plurality of image forming sections each having an image bearing member.

Figure 9:
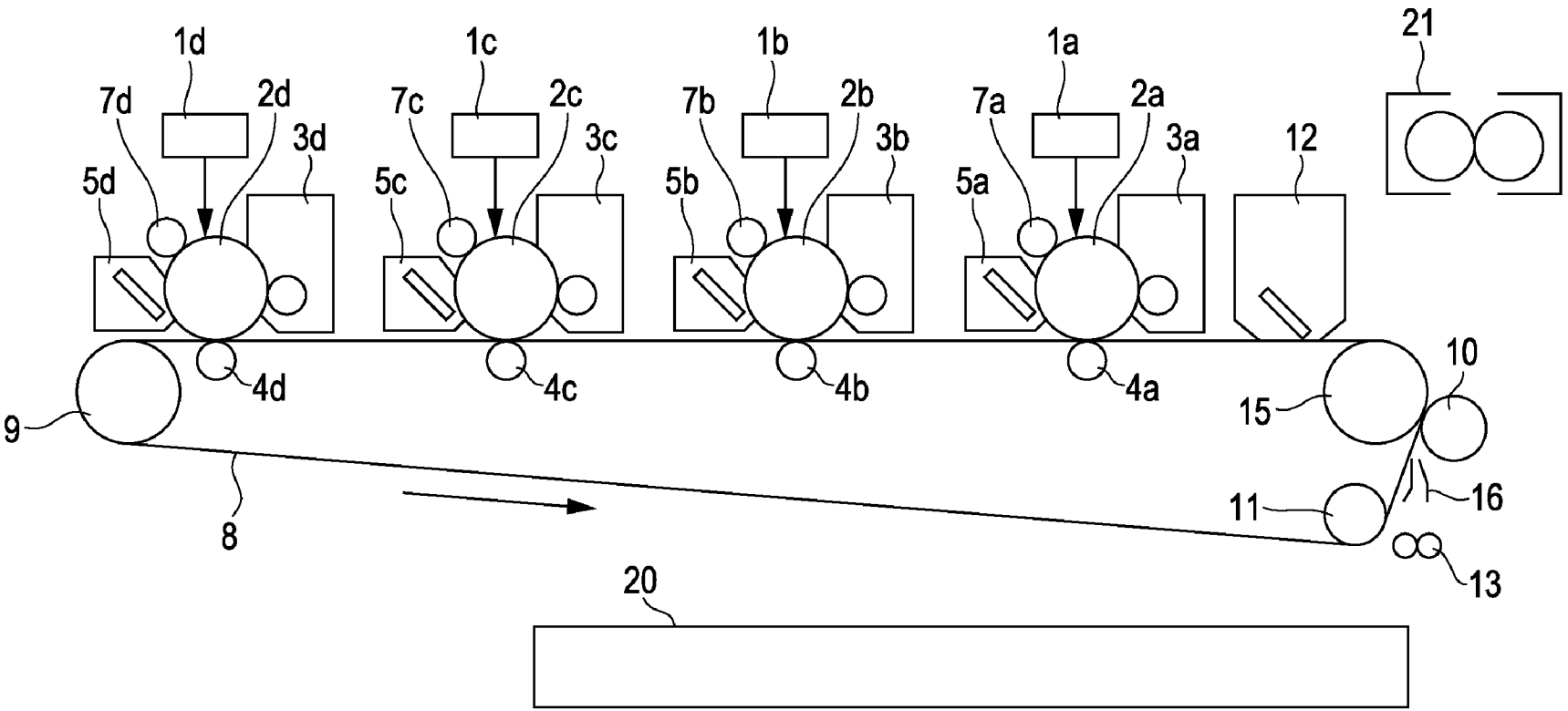
FIG. 9 is sectional view showing the overall configuration of an image forming apparatus according to related art.

The same components as those of the image forming apparatus of the related art, shown in FIG. 9, are given the same reference numerals, and their duplicated descriptions will be omitted. Also in this embodiment, image formation is performed as in the related-art image forming apparatus. That is, toner images are formed on the surfaces of the photosensitive drums 2 in the individual image forming sections by the same image forming process as in the related art, the toner images are transferred in layers onto the intermediate transfer belt 8 from the individual image forming sections, and it is transferred onto a transfer material. The transferred toner image is fixed to the transfer material and is output as an image-formed material. Next, the individual image forming sections at which image forming operation is performed will be specifically described.

The photosensitive drums 2 at the individual color-image forming sections are negatively charged photosensitive members having a diameter of 30 mm, which become evenly charged at about −650 V by application of charging bias, in which an AC component is superposed on a DC component, to the charging rollers 7. The exposure devices 1 each have a near-infrared laser diode (not shown) having a wavelength of 760 nm and a polygon scanner that applies a laser beam onto the photosensitive drum 2 and decreases the potential of the imaging portion to −250 V (forms an electrostatic latent image according to image data). The developing units 3 are contact developing units that use a non-magnetic one-component toner as a developer and develop images by bringing the toner into contact with the electrostatic latent images on the photosensitive drums 2. The primary transfer rollers 4 are rotated as the intermediate transfer belt 8 moves. A 300-V primary transfer voltage is applied to core metals in the primary transfer rollers 4, so that the toner images on the photosensitive drums 2, that is, on the image bearing members, are primarily transferred to the intermediate transfer belt 8.

The intermediate transfer belt 8 is stretched over the secondary-transfer counter roller 15 serving also as a driving roller, the tension roller 9, and the stretching roller 11. The counter roller 15 is formed such that a core metal with a diameter of 30 mm is coated with EPDM rubber 500 Ωm in thickness whose resistance is adjusted using carbon black. The tension roller 9 is an aluminum hollow cylinder with a diameter of 30 mm, which has springs on both-end bearing portions and stretches the intermediate transfer belt 8 with a total pressure of 40 N. The stretching roller 11 is a stainless roller with a diameter of 20 mm, which is rotationally driven by the intermediate transfer belt 8. The intermediate transfer belt 8 is a single-layer endless seamless belt with a thickness of 75 Ωm, a peripheral length of 1000 mm, and a width (width in the direction of image formation) of 320 mm, which is formed of polyimide whose resistance is adjusted by carbon dispersion.

Next, the configuration of the secondary transfer section will be described.

The secondary transfer section includes a rotatable transfer-material bearing member 31 that carries a transfer material, a secondary transfer roller 10, a driving roller 33, a secondary-transfer-belt cleaner (brush roller) 34, a counter roller 35, and an attracting roller 36. The transfer-material bearing member 31 is a seamless secondary-transfer belt 31. The counter roller 35 functions both as a counter roller 35 for the brush roller 34 and a tension roller for adjusting the tension of the secondary-transfer belt 31. As an alternative, a separate tension roller may be provided. The attracting roller 36 and the brush roller 34 are configured to hold a distance from the counter roller 35 by being located with reference to the axis of the counter roller 35.

The attracting roller 36 is for electrostatically attracting the transfer material P conveyed from the paper cassette 20 onto the surface of the secondary-transfer belt 31. For example, the attracting roller 36 is formed such that a core metal is coated with conductive elastic material, such as EPDM, urethane rubber, or NBR, whose volume resistance is adjusted to about $10^5$ to $10^8$ Ω·cm, on which an intermediate layer, formed of urethane or the like, with a thickness of about 200 to 600 μm, and on which a surface layer with a thickness of about 250 μm is provided. The surface layer is formed of styrene or the like.

The attracting roller 36 is pressed onto the counter roller 35 with the secondary-transfer belt 31 therebetween by applying a spring pressure of about 0.04 to 0.5 N to the core metal portions at both ends of the attracting roller 36, thereby rotating with the movement of the secondary-transfer belt 31. This forms an attracting nip portion between the attracting roller 36 and the counter roller 35.

The attracting roller 36 is connected to an attracting-bias applying source which is a constant-voltage power supply. The secondary transfer roller 10 of this embodiment is configured to be rotated with the rotation of the secondary-transfer belt 31; however, the secondary transfer roller 10 may be driven as a driving roller, in which case the number of rollers that support the secondary-transfer belt 31 can also be reduced. The secondary transfer roller 10 is formed such that a core metal with a diameter of 6 mm is coated with an elastic layer formed of foamed hydrin rubber with a thickness of about 4 mm so that it has an outside diameter of 14 mm.

With this configuration, toner does not come into direct contact with the secondary transfer roller 10, which is a transfer member. Therefore, there is no limitation, other than resistance and hardness, to the property of the roller 10; a rubber material, such as EPDM, urethane, NBR, epichlorohydrin rubber, or silicon, can be used as the material of the secondary transfer roller 10. Considering that the secondary-transfer belt 31 made of resin is interposed, it is preferable to use a material with an Asker C hardness of less than 30 under a load of 4.9 N.

The resistance of the secondary transfer roller 10 is measured by pressing the secondary transfer roller 10 to which 50 V is applied to an aluminum cylinder that is rotating at a surface speed of 100 mm/sec under a load of 9.8 N. This measuring method uses a roller with a resistance from $10^6$ to $10^8\Omega$. The secondary transfer roller 10 is disposed inside the secondary-transfer belt 31 and presses the secondary-transfer belt 31 against the secondary-transfer counter roller 15 to thereby form the secondary-transfer nip portion. A load of 4.9 N at one side, a total load of 9.8 N at both sides, is applied using springs to bring the secondary transfer roller 10 into contact with the secondary-transfer counter roller 15.

In this embodiment, the secondary-transfer belt 31 is formed of polyvinylidene DiFluoride (PVdF) with a thickness of 80 mμ. The material of the belt 31 can be PPS, PET, polyimide, or PEEK, in addition to PVdF. There is a risk of a decrease in transfer performance of rough paper (paper containing large fibers and having a rough surface) with increasing hardness of the secondary transfer section. The configuration of the secondary transfer section in which the low-hardness secondary transfer roller 10 and the resin belt having a high releasing property, as in this embodiment, has both transfer performance and belt-cleaning performance. If a rubber belt is used as the secondary-transfer belt 31, a roller having higher hardness may be used.

The secondary-transfer-belt cleaner 34 will be described later.

The image forming apparatus of this embodiment is an image forming apparatus capable of marginless printing. Here, the marginless printing will be described. This image forming apparatus has a print-with-margin mode in which an image is printed with a margin around the entire periphery of the transfer material P and a marginless print mode in which an image is printed to the frame of the transfer material P, with no margin provided at at least one side of the transfer material P.

Figure 2A:
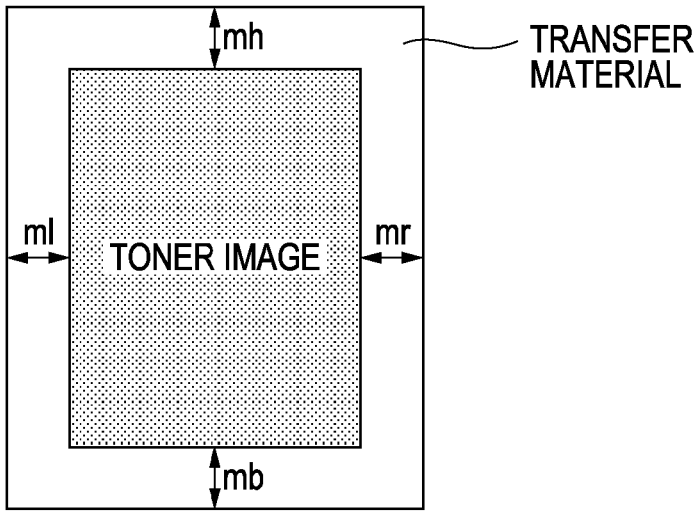
FIG. 2A is a diagram illustrating a print in a print-with-margin mode.
Figure 2B:
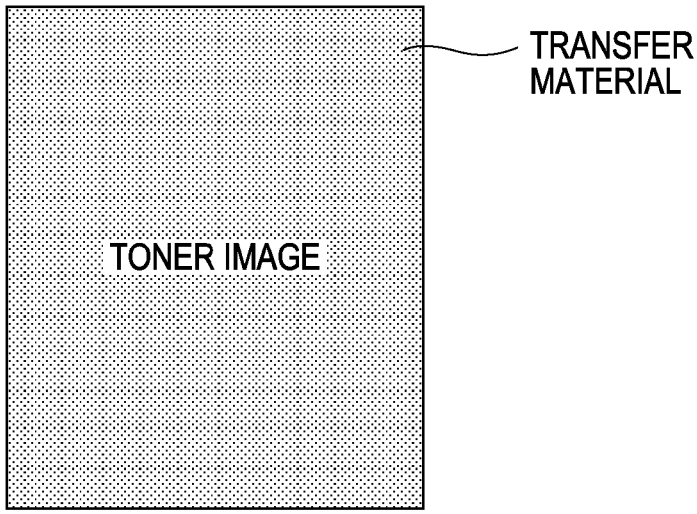
FIG. 2B is a diagram illustrating a print in a marginless print mode.

FIG. 2A shows a print in the print-with-margin mode, and FIG. 2B shows a print in the marginless print mode. In the print-with-margin mode, the entire toner image falls within the transfer material P, in which the upper margin (mh), the lower margin (mb), the left margin (ml), and the right margin (mr) are provided around the periphery of the transfer material P. In contrast, in the marginless print mode, the toner image reaches the edge of the transfer material P, in which no peripheral margin is provided. FIG. 2B shows a state in which all of the upper, lower, left, and right margins are not provided; however, if there is no margin only along one edge, it is defined as marginless printing. Image formation in the marginless print mode will be described hereinbelow.

Figure 3A:
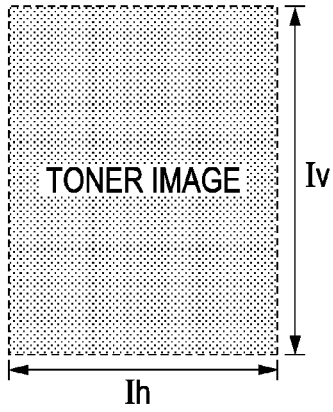
FIG. 3A is a diagram shows the size of a toner image formed in the marginless print mode.
Figure 3B:
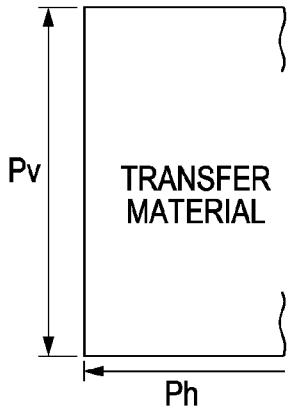
FIG. 3B is a diagram showing the size of a transfer material.
Figure 3C:
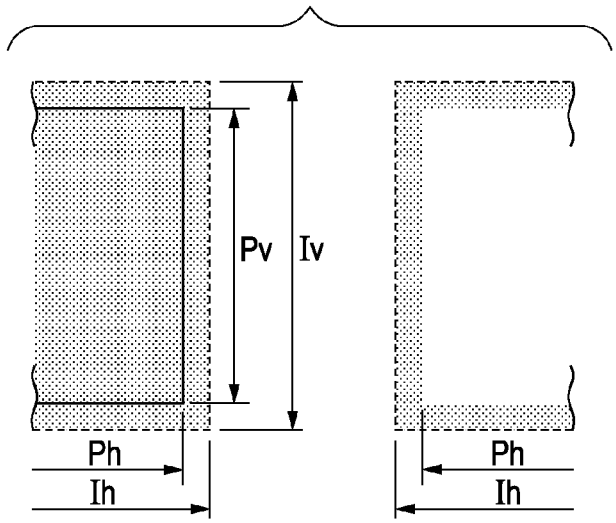
FIG. 3C is a diagram showing the relationship between the toner image in the marginless print mode and the transfer material.

FIGS. 3A to 3C are diagrams illustrating toner-image formation in the marginless print mode. FIG. 3A shows the size of a toner image formed on the intermediate transfer belt 8, where Iv is the length, and Ih is the width. FIG. 3B shows the size of the transfer material P, where Pv is the length, and Ph is the width. The dimensional relationship between the toner image and the transfer material P is set to satisfy Pv<Iv and Ph<Ih. That is, the toner image is formed to be a little larger than a size selected for the transfer material P so that no margin is provided at the transfer material P even if the transfer material P is fed more or less out of position vertically or laterally. A toner image with a size of Iv×Ih, indicated by the broken line, is formed on the intermediate transfer belt 8. The toner image with a size of Iv×Ih is conveyed toward the secondary-transfer region by the intermediate transfer belt 8. On the other hand, the timing of conveyance of the transfer material P is controlled by the registration roller pair 13 and is conveyed to the secondary-transfer region in accordance with the entry of the toner image into the secondary-transfer region. That is, the marginless printing is a mode in which a toner image is formed to the region on the intermediate transfer belt 8 corresponding to the outside of the transfer material P so that the toner image is formed to the edge of the transfer material P.

Here, since the size of the toner image is larger than that of the transfer material P, the toner image on intermediate transfer belt 8 enters the secondary-transfer region earlier than the transfer material P. In the secondary-transfer region, the toner image with the size of Iv×Ih is transferred onto the transfer material P with the size of Pv×Ph. Thus, the frame-shaped toner image as shown in FIG. 3C remains as the remaining secondary-transfer toner.

In this way, in the marginless print mode, the frame-shaped toner image as shown in FIG. 3C is generated as the remaining secondary-transfer toner, and it adheres to the secondary-transfer belt 31. Therefore, in the marginless print mode, the frame-shaped toner image is generated as the remaining secondary-transfer toner, so that a larger amount of toner is prone to adhere to the secondary-transfer belt 31 than in the print-with-margin mode.

Here, the secondary-transfer-belt cleaner 34 that collects the toner that has stuck to the secondary-transfer belt 31 will be described. The secondary-transfer-belt cleaner 34 of this embodiment is a rotatable brush roller 34. The brush roller 34 has a configuration in which a large number of conductive bristles are planted in a core metal and is constructed to have a columnar outer shape as a whole. The base material of the conductive bristles is nylon or polyester, which is provided with conductivity by addition of a conductive agent such as carbon black. The conductive bristles of the brush roller 34 have a volume resistance of $10^8$ to $10^{12}$ Ω·cm. The core metal of the brush roller 34 has a diameter of 6 mm, and the bristles of the brush roller 34 have a length of 4 mm. The fibers of the brush roller 34 have a density ranging from 100 to 430 kF/cm$^2$, and its single fiber has a thickness ranging from 1 to 4 denier.

Although this embodiment uses the brush roller 34 as the cleaner of the secondary-transfer belt 31, a sponge roller may be used instead of the brush roller 34. The brush roller 34 is covered with soft conductive bristles, and the bristles themselves easily move while a large surface area can be provided. Therefore, it has problems in that it is difficult to estimate the exact position to which toner adheres to perform control and that in a system in which the brush roller 34 rotates at a higher speed, the bristles of the brush roller 34 are prone to move due to centrifugal force, so that the toner are prone to scatter. With the sponge roller, the area of contact with the secondary-transfer belt 31 can be decreased depending on the rigidity or the cell diameter of the sponge, and the timing of collecting the toner and the timing of discharging the toner from the cleaner can easily be controlled, which leads to increased throughput. This becomes a useful means particularly for a system in which the amount of toner to be collected per unit area is small.

However, in terms of the amount of toner collected, the amount of collection by the brush roller is larger than that by the sponge roller. In particular, in the case where the amount of toner adhering to the secondary-transfer belt 31 is large as in the marginless print mode, it is desirable to use the brush roller.

In this embodiment, the brush roller 34 receives driving from the counter roller 35 via a gear (not shown) and is configured to rotate in the direction opposite to the rotating direction of the secondary-transfer belt 31, so that it rotates in the counter direction in contact with the secondary-transfer belt 31. The brush roller 34 may be rotated in the forward direction; however it is desirable that it be moved in the counter direction at the collecting position because the toner collection by the brush roller 34 owes to the mechanical scraping force thereof.

It is desirable that the amount of entry of the brush roller 34, which is the secondary-transfer-belt cleaner, into the secondary-transfer belt 31 that is backed up by the counter roller 35 range from about 0.5 to 1.5 mm. If it is less than 0.5 mm, a stable nip cannot be formed between the secondary-transfer belt 31 and the brush roller 34, resulting in unstable toner collection. In contrast, if the amount of entry is too large, the brush roller 34 is plastically deformed by a large amount while the image forming apparatus is halted, thus posing risks of unstable contact between the secondary-transfer belt 31 and the brush roller 34, an increase in the rotation torque of the brush roller 34, and frictional degradation thereof. If the problems of the plastic deformation and frictional degradation of the brush roller 34 cannot be solved even by controlling the amount of entry to the secondary-transfer belt 31, it is desirable to set the brush roller 34 to be brought into and out of contact with the secondary-transfer belt 31.

Next, a process of cleaning the toner adhering to the secondary-transfer belt 31 during the secondary-transfer process in the marginless print mode in which a large amount of toner adheres to the secondary-transfer belt 31 will be described.

Figure 4:
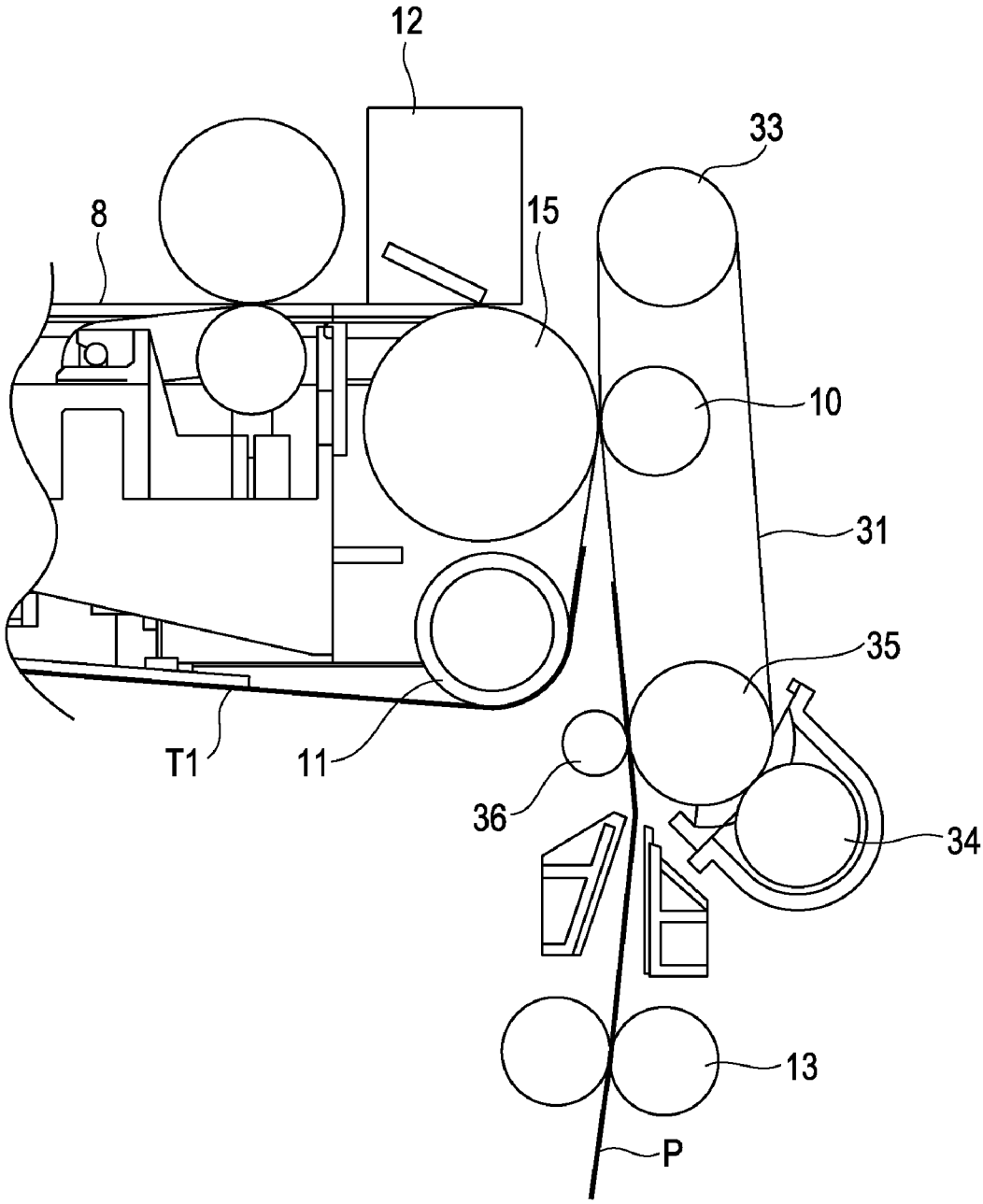
FIG. 4 is a diagram illustrating the state of conveyance of a transfer material before the transfer material enters a transfer nip portion.
Figure 5:
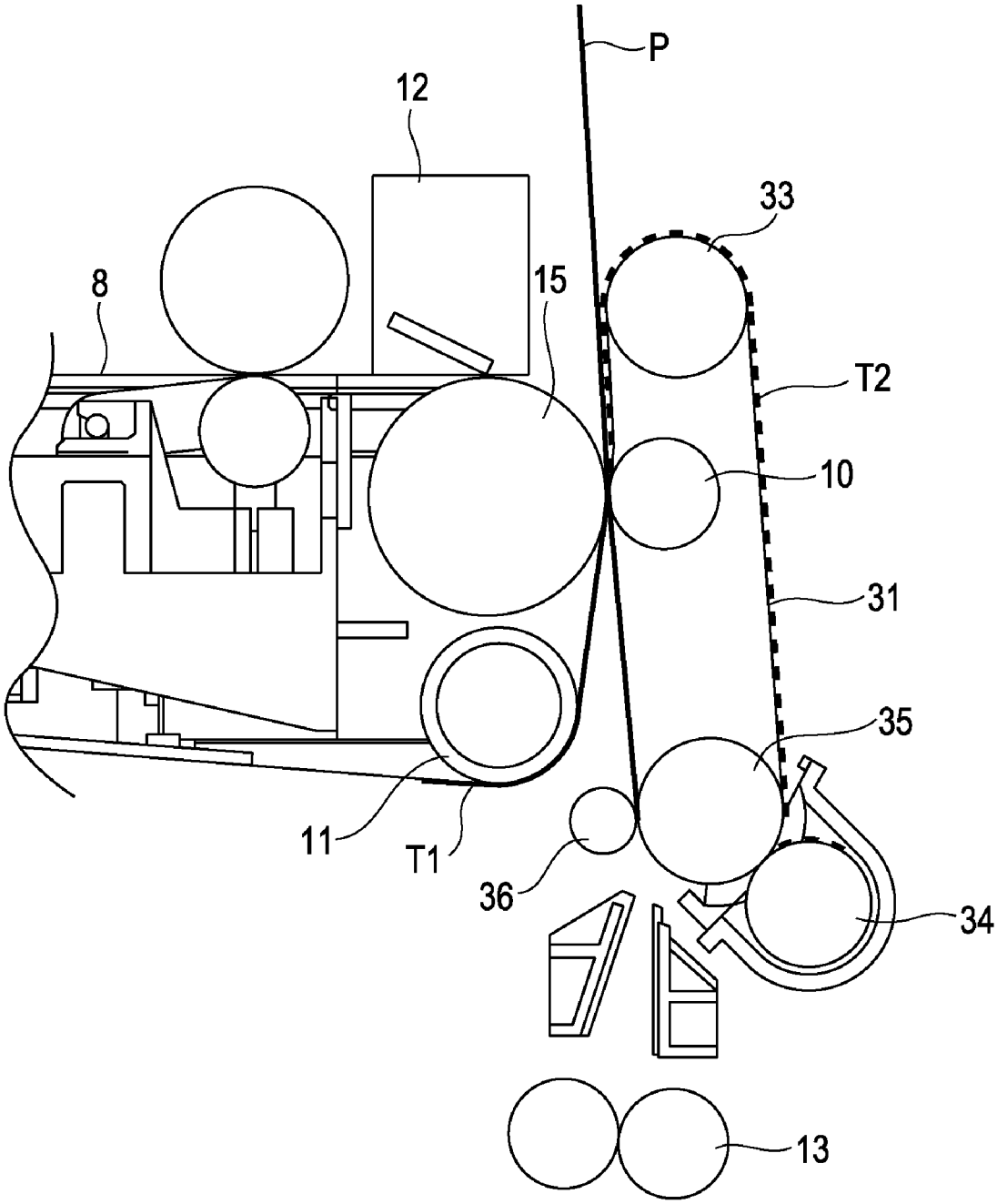
FIG. 5 is a diagram illustrating the state of conveyance of the transfer material when a collecting member collects stuck toner.

The transfer material conveyed from the paper cassette 20 is conveyed by the registration roller pair 13, which is a next-stage conveying device, is attracted onto the secondary-transfer belt 31 by becoming charged by the attracting roller 36, and is conveyed to the secondary transfer section. A secondary-transfer bias supply (not shown) is connected to the core metal of the secondary transfer roller 10 via a power supply spring. The secondary transfer roller 10 is given the secondary-transfer bias by the secondary-transfer bias supply connected thereto. On the other hand, in the marginless print mode, a toner image with a size protruding from the transfer material P (paper) is formed on the intermediate transfer belt 8 and is transferred to the edge of the transfer material P at the transfer nip. At the same time, the toner image protruding from the transfer material P is transferred onto the secondary-transfer belt 31. This is shown in FIGS. 4 and 5. The toner image transferred onto the transfer material P is conveyed as the transfer material P is conveyed to the fixing unit 21 and is fixed onto the transfer material P by the fixing unit 21.

Figure 6:
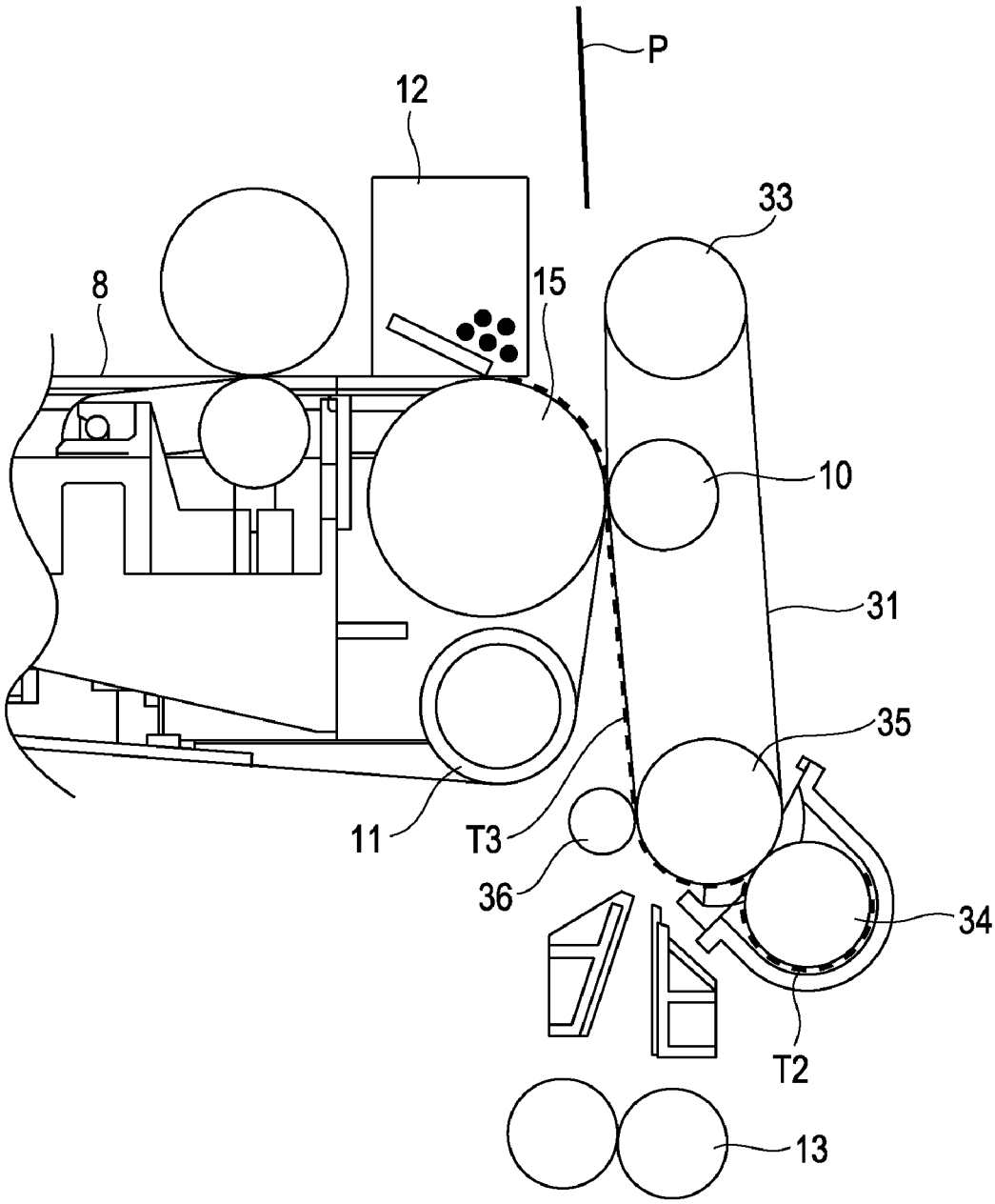
FIG. 6 is a diagram illustrating the state of conveyance of the transfer material after the transfer material passes through the transfer nip portion.
Figure 7:
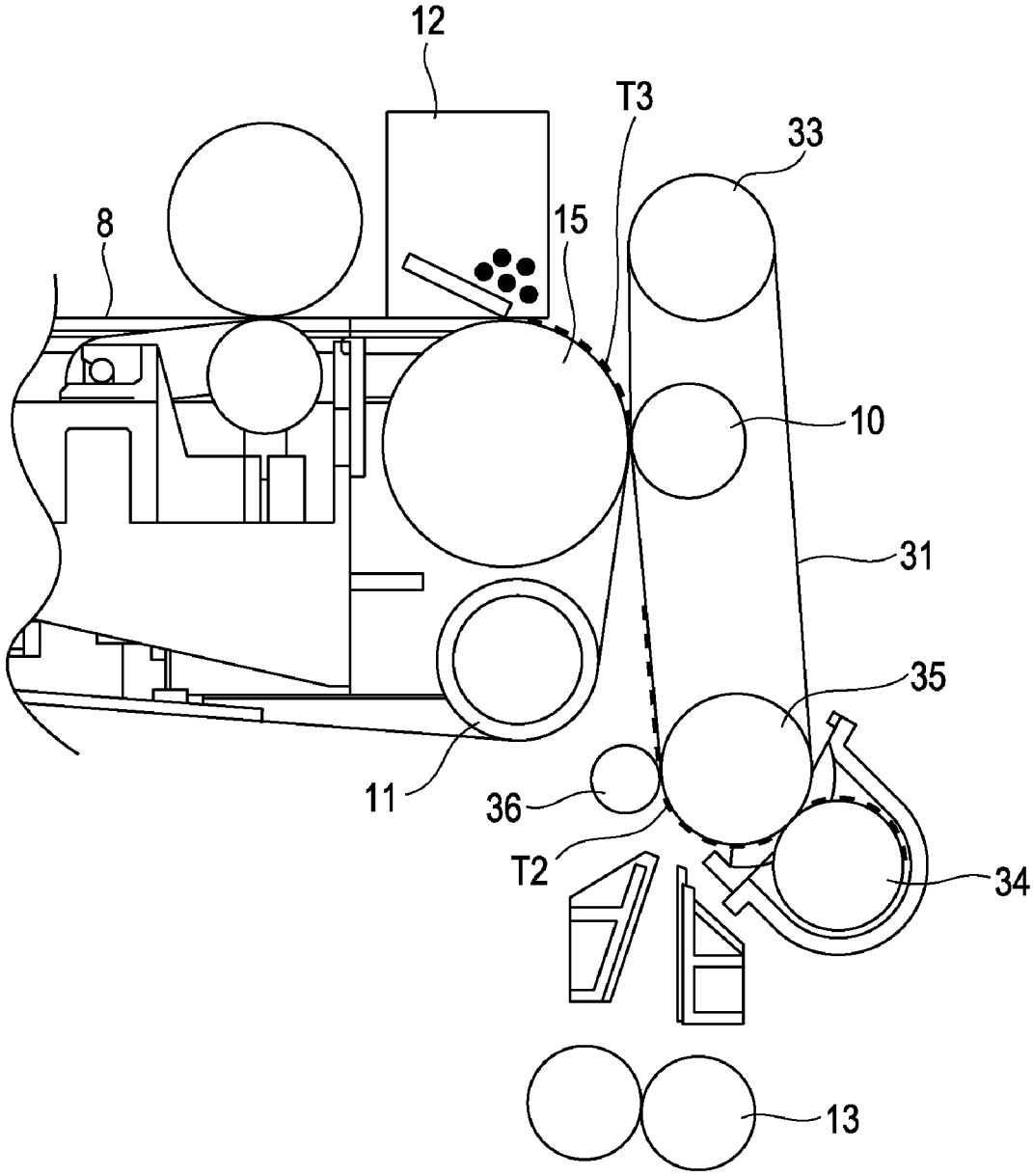
FIG. 7 is a diagram illustrating a state in which the stuck toner is transferred from the collecting member to a cleaning unit.

As shown in FIG. 5, the toner protruding from the transfer material P and to be transferred onto the secondary-transfer belt 31 is temporarily collected by the brush roller 34 opposed to the counter roller 35 so as not to stain the back of the transfer material P to which the toner image is transferred from the intermediate transfer belt 8. As shown in FIG. 6, the temporarily collected toner is again transferred (discharged) onto the secondary-transfer belt 31 between the transfer materials P by the time the next transfer material P reaches the secondary-transfer position. The toner is then transferred onto the intermediate transfer belt 8 at the secondary transfer section and is collected into a toner container portion by a cleaning blade in the intermediate-transfer-member cleaner 12 disposed on the intermediate transfer belt 8. In this embodiment, the intermediate-transfer-member cleaner 12 is a cleaning unit that cleans the toner that remains on the intermediate transfer belt 8 after the toner passes through the transfer nip portion. The cleaning unit may have a configuration in which the remaining toner is again transferred from the intermediate transfer belt 8 onto the photosensitive drums 2 and is collected by the photosensitive-drum cleaning units 5.

Here, the image-formation processing speed in the marginless print mode in this embodiment is 60 mm/sec. That is, the rotational speed of the intermediate transfer belt 8 is 60 mm/sec.

In this embodiment, in the marginless print mode, the conveyance of transfer material P can be stabilized using the secondary-transfer belt 31, which can prevent troubles due to unstable behavior of the leading end of the transfer material P. Furthermore, the amount of toner adhering to the end of the transfer material P can be reduced at the secondary transfer section, which can prevent the stain of the guide which is generated in the process of conveying the transfer material P to the fixing nip and the adhering of toner onto the fixing member.

Here, the operation of transferring a toner image that is longer in the rotating direction of the intermediate transfer belt 8 than the peripheral length of the secondary-transfer belt 31 in the marginless print mode will be described more specifically with reference to FIGS. 4 to 7.

As shown in FIG. 4, the transfer material P fed from the paper cassette 20 is conveyed at the timing adjusted to a toner image T1 transferred onto the intermediate transfer belt 8 by the registration roller pair 13 and is moved into the secondary-transfer nip portion. The toner image T1 on the intermediate transfer belt 8 is transferred onto the transfer material P at the transfer nip.

As shown in FIG. 5, a remaining toner T2 that protrudes from the transfer material P during the secondary transfer is transferred onto the secondary-transfer belt 31 and is temporarily collected by the brush roller 34 opposed to the counter roller 35.

The voltage applied to the brush roller 34 when the toner is temporarily collected is set to a polarity opposite to the negative-polarity toner, that is, a positive-polarity DC bias. Since the toner transferred onto the secondary-transfer belt 31 is transferred using a transfer bias, most of it is negatively charged. Thus, there is no need to recharge the toner before collection.

With the image forming apparatus of this embodiment, the maximum passable length of the transfer material P is 297 mm (A4 size), on which an image having a length of 305 mm in the direction of image forming processing is formed in the marginless print mode in consideration of the displacement of the leading end of the transfer material P and the expansion of the image. Accordingly, ideally, additional 4-mm toner is directly transferred onto the secondary-transfer belt 31 corresponding to the leading end and the trailing end of the transfer material P. On the other hand, the peripheral length of the secondary-transfer belt 31 is 200 mm. That is, the image forming apparatus of this embodiment can transfer a toner image with a length in the rotating direction of the intermediate transfer belt 8 longer than the peripheral length of the secondary-transfer belt 31 onto the transfer material P in the marginless print mode. In this case, if A4-size marginless printing is performed without executing cleaning on the secondary-transfer belt 31, the back of the transfer material P is stained in the range of about 100 mm from the trailing end of the transfer material. Accordingly, in the image forming apparatus capable of transferring a toner image with a length in the rotating direction of the intermediate transfer belt 8 longer than the peripheral length of the secondary-transfer belt 31 onto the transfer material P in the marginless print mode, of the additional toner transferred onto the secondary-transfer belt 31, toner of a portion corresponding to the difference between the peripheral length of the secondary-transfer belt 31 and the length of the toner image should be collected. In this embodiment, the toner image has a length of 305 mm in the rotating direction of the intermediate transfer belt 8, and the peripheral length of the secondary-transfer belt 31 is 200 mm, a stain generated in the range of about 100 mm from the trailing end of the transfer material P can be prevented if the leading end about 100 mm can be temporarily collected. In this embodiment, the toner adhering to the secondary-transfer belt 31 is collected at the time when the toner adhering to the secondary-transfer belt 31 first reaches, and the collection of the toner is completed at the time when the amount corresponding to the difference between the peripheral length of the secondary-transfer belt 31 and the length of the toner image in the rotating direction the intermediate transfer belt 8 has been collected.

As shown in FIG. 6, after the remaining toner T2 at the leading end about 100 mm of the transfer material P has been collected by the brush roller 34, the voltage applied to the brush roller 34 is reversed. Thus, the collection of the remaining toner T2 on the secondary-transfer belt 31 to the brush roller 34 is stopped. Alternatively, after the remaining toner T2 at the leading end has been collected by the brush roller 34, the application of the voltage to the brush roller 34 may be stopped.

This allows a remaining toner T3 at the trailing end on the secondary-transfer belt 31 is conveyed without being collected by the brush roller 34 and is transferred onto the intermediate transfer belt 8 at the secondary transfer section. The remaining toner T3 is then collected into the toner container portion by the cleaning blade in the intermediate-transfer-member cleaner 12 disposed on the intermediate transfer belt 8.

The rotation is controlled so that the remaining toner T2 collected by the brush roller 34 again comes into contact with the secondary-transfer belt 31 after a predetermined period of time after the remaining toner T3 at the trailing end on the secondary-transfer belt 31 passes the brush roller 34. This allows the reverse-biased remaining toner T2 to be transferred onto the secondary-transfer belt 31. As described above, in the case where application of voltage to the brush roller 34 is stopped after the remaining toner T2 at the leading end has been collected by the brush roller 34, a negative-polarity bias, which has the same polarity as the toner, is applied at this timing. Then, the remaining toner T2 collected by the brush roller 34 is again transferred onto the secondary-transfer belt 31. The following collection to the intermediate-transfer-member cleaner 12 is described above.

It is also possible to eliminate the cleaning unit that temporarily collecting the remaining toner by transferring it onto the intermediate transfer belt 8 while no image is being formed without cleaning the secondary-transfer belt 31 by setting the peripheral length of the secondary-transfer belt 31 sufficiently longer than the maximum passable length of the transfer material P.

However, this increases the peripheral length of the secondary-transfer belt 31, which makes it difficult to make the apparatus compact, leading to an increased cost for the apparatus. Furthermore, even if the user does not print transfer material with the maximum passable length, transfer to the next transfer material cannot be performed until the long secondary-transfer belt 31 makes one round to discharge the remaining toner onto the intermediate transfer belt 8 for cleaning, which poses the problem of decreasing the throughput.

Accordingly, to make the apparatus compact by minimizing the length of the secondary-transfer belt 31, this embodiment is configured such that a toner image that is longer in the rotating direction of the intermediate transfer belt 8 than the peripheral length of the secondary-transfer belt 31 can be transferred onto the transfer material P in the marginless print mode. In this case, the brush roller 34, which is a cleaner for the secondary-transfer belt 31, is provided, as described above, to collect part of the toner on the secondary-transfer belt 31.

Furthermore, there is no need for a waste-toner box on the secondary-transfer belt 31 for collecting the remaining toner. This makes the apparatus compact and eliminates the need for the user to dispose of a plurality of waste-toner boxes, thus improving the usability. Moreover, minimizing the time to collect toner with the brush roller 34 can prevent clogging of the brush roller 34 with the toner, increasing the life of the brush roller 34.

When a transfer material shorter than the minimized secondary-transfer belt 31 is printed in the marginless print mode, there is no need to temporarily collect the toner by the brush roller 34; thus, the collection may not be performed. If the collection is not performed, the throughput can be improved as compared with the case in which the collection is performed.

In this embodiment, no collection is performed in the print-with-margin mode in which an image with a margin around the periphery of the transfer material P is printed, because the amount of toner adhering to the secondary-transfer belt 31 is small. Thus, the throughput in the print-with-margin mode is improved by performing no collection.

Second Embodiment

The configuration of an image forming apparatus according to a second embodiment is substantially the same as that of the image forming apparatus according to the first embodiment. Accordingly, components having the same function as the image forming apparatus described in the first embodiment are given the same reference numerals, and descriptions thereof will be omitted. In the description below, components different from the image forming apparatus described in the first embodiment are mainly described.

This embodiment also has a configuration, as in the first embodiment, in which the toner adhering onto the brush roller 34 is discharged onto the secondary-transfer belt 31 and is further transferred to the intermediate transfer belt 8, and the toner is finally collected by the cleaning blade that is in contact with the intermediate transfer belt 8, and in which there is no other unit for discharging the toner on the brush roller 34 therefrom.

In the case where the brush roller 34 is used as the secondary-transfer-belt cleaner 34 to collect the remaining toner T2, when the brush roller 34 is rotated one round or more, part of the remaining toner T2 that is temporarily held on the brush roller 34 may adhere onto the secondary-transfer belt 31 when it again comes into contact with the secondary-transfer belt 31. If the remaining toner T2 adheres to the secondary-transfer belt 31 again, it may be transferred to the back of the transfer material P at the secondary transfer section to stain the back of the transfer material P. Examples of toner that is prone to again adhere onto the secondary-transfer belt 31 are low-charged toner and toner deposited in layers on the brush roller 34. When the remaining toner T2 is collected from the secondary-transfer belt 31 by the brush roller 34, a discharge can be generated due to the gap between the brush roller 34 and the secondary-transfer belt 31, so that the charge polarity of the toner is sometimes reversed. This reversed-polarity toner is also prone to again adhere to the secondary-transfer belt 31 when coming into contact with the secondary-transfer belt 31 again.

The collection of the remaining toner T2 onto the brush roller 34, as described above, heavily depends on the physical scraping force of the brush roller 34 that is different in peripheral speed from the secondary-transfer belt 31. The adhering force of such toner T2 to the bristles of the brush roller 34 is significantly small. Accordingly, part of the remaining toner T2, described above, again adheres onto the secondary-transfer belt 31 when the secondary-transfer belt 31 and the brush roller 34 come into contact again, causing the stain of the back of the transfer material P.

Accordingly, this embodiment completes the collection of the remaining toner T2 with the brush roller 34 during one round of the brush roller 3. Specifically, the rotational speed of the brush roller 34 is set to 0.5 rps, that is, the surface speed is set to 22 mm/sec, so that toner corresponding to about 120 mm at the maximum can be collected per round of the brush roller 34 by the primary collection. That is, it is configured to complete the collection of the remaining toner T2 within one round of the brush roller 34. Setting the rotational speed of the brush roller 34 lower than that of the secondary-transfer belt 31 increases the range of primary collection in the direction of image formation processing; while on the other hand, rotationally driving the secondary-transfer belt 31 and the brush roller 34 with a common driving unit, as in this embodiment, poses a demerit of taking much time for toner discharge operation. In this embodiment, to execute the primary toner collection and toner discharge operation for each sheet in a short time, the maximum collection length per round of the brush roller 34 is set to 120 mm, which is relatively close to the length 105 mm of the length 105 mm of the remaining toner T2.

The moving speed of the surface of the brush roller 34 may be higher than the moving speed of the surface of the secondary-transfer belt 31; however, it is not desirable in the configuration in which the cleaning is completed during one round of the brush roller 34 because it increases the size of the brush roller 34, influencing the size of the apparatus main body.

Application of voltage to the brush roller 34 is started a predetermined time before the leading end of the image reaches the contact position between the brush roller 34 and the secondary-transfer belt 31 and is controlled so that a predetermined constant current flows from the brush roller 34 to the counter roller 35 opposed thereto. In this embodiment, the target constant current is set at 10 μA. In this embodiment, the application of voltage to the brush roller 34 is under constant current control; however, constant voltage control can be selected depending on the configuration, such as when a current detection circuit for detecting the current value is not provided.

Actual toner collecting operation is started when the leading end of the image reaches the brush roller 34.

If the voltage to be applied to the brush roller 34 is controlled in advance before the remaining toner T2 reaches the brush roller 34, the toner added to the leading end of the image, which is noticeable as a stain of the back, can be primarily collected with stability. Furthermore, completing the primary collection of the remaining toner T2 before the toner at the leading end of the image collected by the brush roller 34 again comes into contact with the secondary-transfer belt 31 can also prevent the stain of the back. The primary collecting operation by the brush roller 34 is completed before the brush roller 34 makes one round after the start of the primary collecting operation.

At the same time as the collection of the remaining toner T2 is completed, the polarity of the voltage applied to the brush roller 34 is reversed from that during the collection, that is, to a negative polarity. This allows, as shown in FIG. 4, the discharge of the remaining toner T2 from the brush roller 34 can be performed with high efficiency at the same time as the toner collection from the secondary-transfer belt is stopped. To execute the primary collection and discharge of the toner with high efficiency, the time to switch the polarity of the voltage applied to the brush roller 34 should be subtracted from the time for one round of the brush roller 34. The collection of the toner to the intermediate-transfer-member cleaner 12 thereafter is described above. On the other hand, if a high-density image has stuck to the secondary-transfer belt 31 without being transferred to the transfer material P due to an error in conveying the transfer material P etc., a large amount of toner adheres to the brush roller 34. Therefore, discharging it from the brush roller 34 at once imposes a load on the blade cleaner of the secondary-transfer belt 31, which is the final toner collecting member. Accordingly, the voltage to be applied to the brush roller 34 may be turned off in combination with jam detection, image-pattern detection, etc to control the amount of toner discharged from the brush roller 34.

The amount of collection by one round of the brush roller 34 may be set to the difference between the peripheral length of the secondary-transfer belt 31 and the length of the toner image in the rotating direction of the intermediate transfer belt 8, as in the first embodiment. Specifically, the brush roller 34 starts the collection of the toner adhering to the secondary-transfer belt 31 from the time when the toner reaches the brush roller 34 first and completes the collection before the brush roller 34 makes one round.

The case in which the image is longer than the peripheral length of the secondary-transfer belt 31 has been described; if the image is shorter than the peripheral length of the secondary-transfer belt 31, that is, in the case of a small-size print, the stain of the back hardly occurs even if no toner collection is performed, and therefore, the voltage to be applied to the brush roller 34 can be turned off or may be set at the same polarity as that of the toner. This prevents toner from adhering to the brush roller 34, which can omit the operation of discharging the toner from the brush roller 34, thus improving the usability. As described above, the remaining toner T3 at the trailing end on the secondary-transfer belt 31, which is not to be collected, is conveyed without being collected by the brush roller 34 and is transferred onto the intermediate transfer belt 8 at the secondary transfer section together with the remaining toner T2 discharged from the brush roller 34. The toner is then collected into the waste-toner box by the cleaning blade in the intermediate-transfer-member cleaner 12 disposed on the intermediate transfer belt 8.

Third Embodiment

Figure 8:
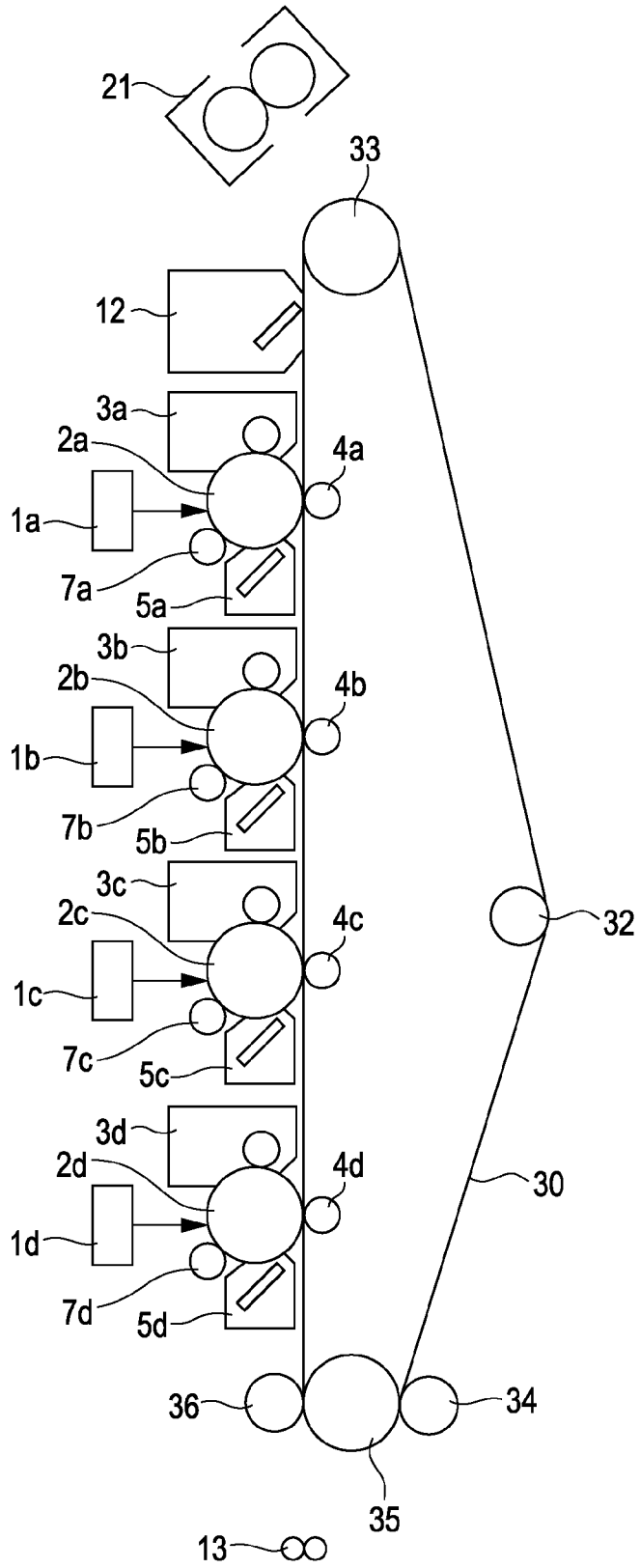
FIG. 8 is a sectional view showing the overall configuration of an image forming apparatus according to a third embodiment.

FIG. 8 shows the configuration of a third embodiment. The third embodiment will be described hereinbelow with reference to the drawing, in which the components with the same configuration and operation as in the first embodiment are given the same reference numerals and their descriptions will be omitted.

This embodiment is an image forming apparatus that employs a system in which toner images on the photosensitive drums are directly transferred onto a transfer material that is attracted and conveyed on a transfer conveying belt.

In this embodiment, an electrostatic attraction belt 30 is stretched by three shafts, that is, the driving roller 33, a tension roller 32, and the counter roller 35. The brush roller 34 is opposed to the counter roller 35, as a temporary collection roller.

In the final collection of the toner on the electrostatic attraction belt 30 (cleaning mode), the toner is reversely transferred onto the photosensitive drums 2 at the transfer section, is scraped by drum cleaning blades that are in contact on the photosensitive drums 2, and is collected into cartridge containers. In this embodiment, the drum cleaning blades and the cartridge containers serve as cleaning units.

The reverse transfer onto the photosensitive drums 2 allows collection of toner with both polarities by applying a bias with a polarity opposite to that during printing at the 1st and 3rd drums 2 and by applying a bias with a polarity as in printing at the 2nd and 4th drums 2. Increasing the rotational speed of the photosensitive drums 2 by 30% relative to the electrostatic attraction belt 30 can improve the toner collection performance, thereby reducing the cleaning time.

In this embodiment, the peripheral length of the electrostatic attraction belt 30 is 560 mm, the maximum passable length of the transfer material P is 297 mm, and the interval between the transfer materials P is 50 mm. Therefore, marginless printing is allowed by repeating a normal print mode and a cleaning mode for each sheet. However, this needs a cleaning time of about 20 sec for each printing, resulting in significantly low print productivity.

Thus, as shown in the embodiment, the use of the brush roller 34 allows the toner adhering to the electrostatic transfer belt 30 during printing to be temporarily collected, which need only to perform the cleaning mode every plurality of sheets, thus improving the throughput. In this embodiment, two sheets can be continuously printed by cleaning the leading end of 100 mm; off course, further improvement in productivity is allowed depending on parameters, such as the outside diameter of the brush roller 34, the peripheral length of the electrostatic attraction belt 30, and the size of the transfer material.

Advantages of the use of the brush roller 34 as a transfer belt cleaner include little influence on the degradation of the belt 30, as described in the related art.

Thus, in this embodiment, in the image forming apparatus having the marginless print mode, print productivity (output capability) can be improved by bringing the brush roller 34 serving as a belt cleaner into contact with the electrostatic attraction belt 30 and collecting part of the toner with the brush roller 34. Moreover, there is no need for a waste-toner box for collecting the remaining toner on the electrostatic attraction belt 30, which can make the apparatus compact and eliminates the need for the user to dispose of a plurality of waste-toner boxes, thus improving the usability.

While the present invention has been described with reference to exemplary embodiments, it is to be understood that the invention is not limited to the disclosed exemplary embodiments. The scope of the following Claims is to be accorded the broadest interpretation so as to encompass all modifications and equivalent structures and functions.

This application Claims the benefit of Japanese Patent Application No. 2008-148202 filed Jun. 5, 2008, which is hereby incorporated by reference herein in its entirety.

What is claimed is:

1. An image forming apparatus comprising:

a rotatable image bearing member configured to bear a toner image;

a rotatable intermediate transfer member to which the toner image is transferred from the image bearing member;

a rotatable transfer-material bearing member configured to bear a transfer material;

a transfer member that forms a transfer nip portion with the intermediate transfer member, with the transfer-material bearing member therebetween, and is configured to be able to transfer the toner image on the intermediate transfer member to the transfer material carried by the transfer-material bearing member;

a rotatable collecting member configured to collect toner adhering to the transfer-material bearing member after the toner passes through the transfer nip portion;

a cleaning unit configured to clean the toner remaining on the intermediate transfer member after the toner passes through the transfer nip portion;

wherein the collecting member collects the toner adhering to the transfer-material bearing member at the time when the toner adhering to the transfer-material bearing member reaches the collecting member first, completes the collection of the toner at the time when an amount of toner corresponding to a difference between a peripheral length of the transfer-material bearing member and a length of the toner image on the intermediate transfer member in the rotating direction of the intermediate transfer member has been collected, and transfers the collected toner to the transfer-material bearing member after the toner image is transferred from the intermediate transfer member to the transfer material, and the toner that is transferred from the collecting member to the transfer-material bearing member is transferred from the transfer-material bearing member to the intermediate transfer member by the transfer member and is then cleansed by the cleaning unit.

2. The image forming apparatus according to claim 1, comprising:

a marginless print mode in which a toner image is formed from a region corresponding to the transfer material to a region corresponding to the outside of the transfer material on the image bearing member, and the toner image is transferred to the edge of the transfer material, wherein in executing the marginless print mode, the collecting member collects the toner adhering to the transfer-material bearing member.

3. The image forming apparatus according to claim 2, wherein in the marginless print mode, the image forming apparatus is capable of transferring a toner image that is longer in the rotating direction of the intermediate transfer member than the peripheral length of the transfer-material bearing member to a transfer material; and when transferring the toner image that is longer in the rotating direction of the intermediate transfer member than the peripheral length of the transfer-material bearing member to the transfer material, the image forming apparatus collects the toner adhering to the transfer-material bearing member with the collecting member while transferring the toner image on the intermediate transfer member, using the transfer member, to the transfer material carried by the transfer-material bearing member.

4. The image forming apparatus according to claim 3, wherein the collecting member is a rotatable brush roller.

5. The image forming apparatus according to claim 1, wherein the collecting member is in contact with the transfer-material bearing member, and the rotating direction of the collecting member at the contact position is opposite to the rotating direction of the transfer-material bearing member.

6. The image forming apparatus according to claim 1, wherein the transfer-material bearing member is a seamless belt.

7. The image forming apparatus according to claim 1, wherein the cleaning unit includes a cleaning blade configured to collect the toner adhering to the intermediate transfer member and a container portion for accommodating the toner that the cleaning blade collects.

* * * * *